United States Patent [19]

Carisella et al.

[11] Patent Number: 5,070,788

[45] Date of Patent: Dec. 10, 1991

[54] METHODS AND APPARATUS FOR DISARMING AND ARMING EXPLOSIVE DETONATORS

[75] Inventors: James V. Carisella, 7524 Garnet, New Orleans, La. 70124; Robert B. Cook, Mandeville, La.

[73] Assignee: J. V. Carisella, New Orleans, La.

[21] Appl. No.: 550,862

[22] Filed: Jul. 10, 1990

[51] Int. Cl.[5] ..... F42C 15/00; E21B 43/116

[52] U.S. Cl. ..... 102/222; 89/1.15; 102/202.1; 175/4.54

[58] Field of Search ..... 102/222, 202.1, 275.7; 89/1.15; 175/4.54, 4.56

[56] References Cited

U.S. PATENT DOCUMENTS

| | | | |
|---|---|---|---|
| 2,084,218 | 6/1937 | Rémondy | 102/222 |
| 2,314,891 | 3/1943 | Moore | 102/222 |
| 2,891,477 | 6/1959 | Swanson | 102/202.6 |
| 2,948,219 | 3/1960 | Sapp | 102/222 |
| 3,002,456 | 10/1961 | Savitt | 102/222 |
| 3,406,630 | 10/1966 | Muller | 102/275 |
| 3,430,566 | 3/1967 | Patterson | 102/202.6 |
| 3,500,748 | 11/1968 | Hager | 102/222 |
| 3,774,541 | 11/1973 | Bratton | 102/275.1 |
| 3,994,201 | 11/1976 | Bendler | 102/202.5 |
| 4,011,815 | 3/1977 | Garcia | 175/4.51 |
| 4,314,614 | 2/1982 | McPhee | 175/4.56 |
| 4,577,544 | 3/1986 | Lee | 89/1.14 |
| 4,759,293 | 7/1988 | Davis | 102/520 |

*Primary Examiner*—David H. Brown

*Attorney, Agent, or Firm*—E. R. Archambeau, Jr.

[57] ABSTRACT

In the representative embodiments of the several methods and apparatus of the invention, a barrier formed of a low-temperature fusible metal alloy having a selected melting point is arranged between the donor and receptor explosives in an otherwise-typical detonator for reliably blocking the transmission of detonation forces from the donor explosive to the receptor explosive until the detonator has been subjected to well bore temperatures which are greater than the melting point of the fusible alloy. By selecting a fusible metal alloy which has a melting point less than the known temperatures of the well bore fluids, when the tool is exposed to those elevated temperatures, the barrier will be predictably transformed to its liquid state thereby allowing the liquid alloy to flow to a non-blocking position away from the detonation path of the donor explosive. In an alternative manner of carrying out the new and improved methods and apparatus of the invention, means are provided to return the fluent fusible metal alloy to its initial detonation-blocking position between the explosives so that the fusible metal alloy will again provide an effective barrier for reliably preventing the detonation of the receptor explosive as the well tool is subsequently recovered from the well bore.

35 Claims, 2 Drawing Sheets

FIG. 1
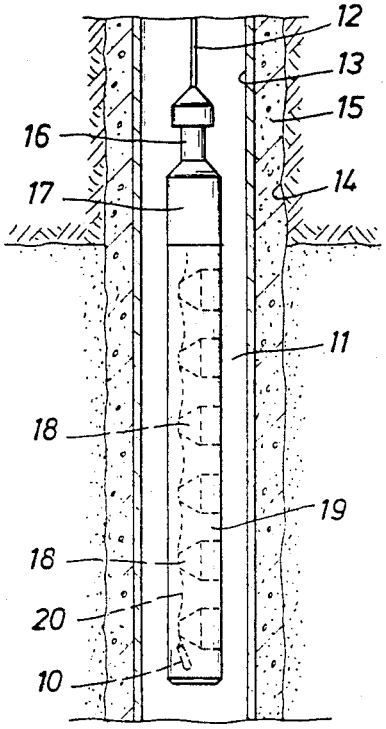
FIG. 2
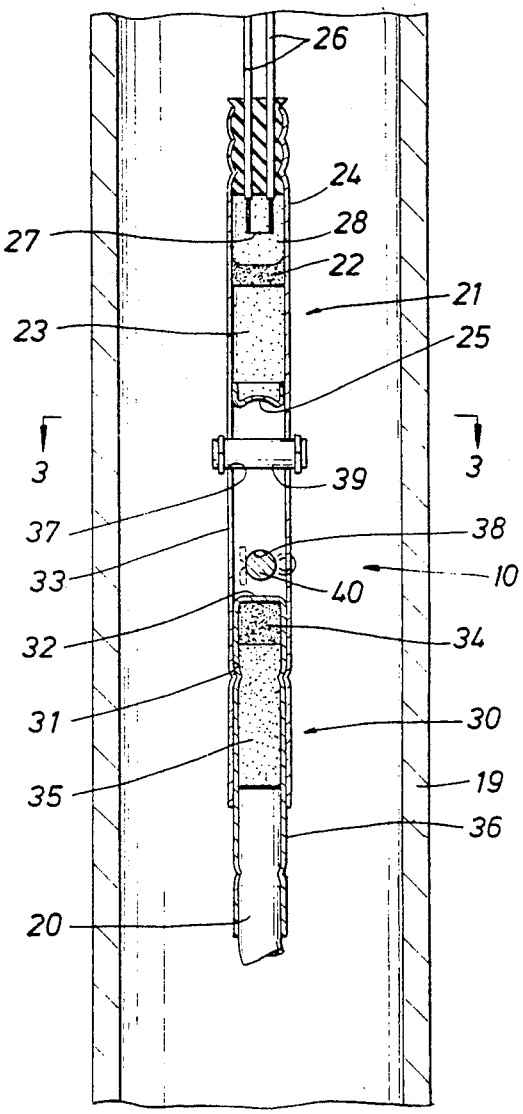
FIG. 4
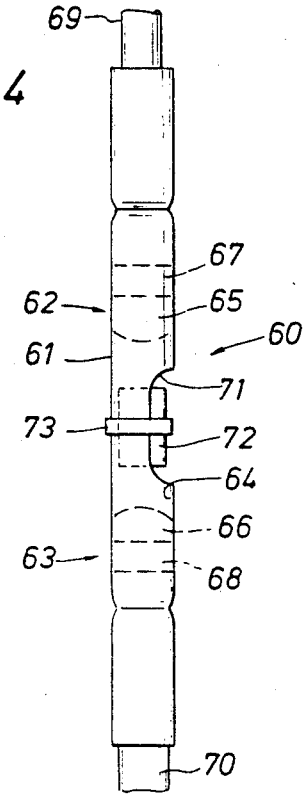
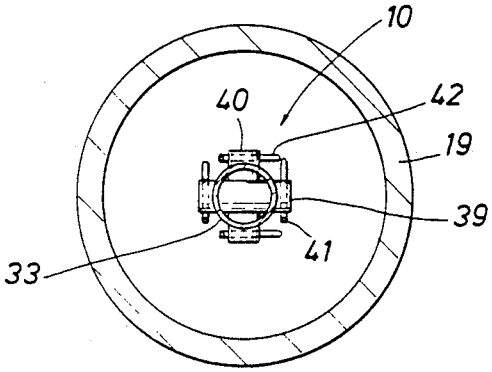
FIG. 3

METHODS AND APPARATUS FOR DISARMING AND ARMING EXPLOSIVE DETONATORS

BACKGROUND OF THE INVENTION

Electrically-actuated or so-called "electric" detonators are typically employed for selectively operating explosive devices on various oilfield tools arranged to be dependently supported in a well bore by a so-called "wireline" or suspension cable which has electrical conductors connected to a surface power source. The electric detonators that are most commonly used on oilfield well tools have a fluid-tight hollow shell in which is encapsulated an igniter charge (such as a black powder or an ignition bead) that is disposed around an electrical bridge wire and positioned next to a primer explosive charge (such as lead azide or some other sensitive primary explosive). In some of these detonators, a booster charge of a secondary explosive (such as RDX or PETN) is arranged in a serial relationship with the primer charge to be detonated by the primer charge.

These electric detonators are used to selectively detonate an explosive detonating cord which, in turn, sets off one or more explosive devices which are carried by a typical wireline tool, such as an oilfield perforator, once the tool is positioned at a desired depth location in a well bore. Other tools employing an electric detonator and detonating cords include explosive cutting tools having an annular shaped explosive charge which produces an omnidirectional planar cutting jet. Wireline chemical cutters similarly employ electric detonators for igniting a gas-producing propellant composition to discharge pressured jets of extremely-dangerous halogen fluoride chemicals against an adjacent tubing or casing wall. Typical explosive backoff tools use an electric detonator for setting off a bundled detonating cord. It is, of course, obvious that each of these various wireline tools will represent serious hazards should they be prematurely actuated whether the tool is still at the surface or has not yet reached its intended position in a well bore.

Those skilled in the art will also recognize that should well bore fluids leak into an enclosed perforating gun before it has been actuated, the carrier can be severely damaged if the gun is fired. To avoid this particular hazard, many proposals have been made, therefore, for permanently disabling the explosives in a hollow-carrier perforating gun should well bore liquids leak into the carrier. As shown in U.S. Pat. No. 2,724,333, for example, pressure-responsive switches have been arranged for permanently disabling the detonator should pressured fluids leak into the enclosed carrier. U.S. Pat. No. 3,372,640 and U.S. Pat. No. 3,430,566 depict typical electric detonators that are arranged so that well fluids leaking into the detonator shell will be effective for permanently desensitizing at least one of the explosives in the detonator. U.S. Pat. Nos. 2,759,417 and 2,891,477 are respectively directed to detonators which will be permanently disabled should well bore liquids leak into the tool body in sufficient quantity to at least partially immerse the detonator. In each of these patents, an interior space is arranged in the detonator between two of the explosives so that should well bore liquids enter that one or more ports communicating with that internal space, the intruding liquid will reliably block the transfer of detonating forces from the donor charge to the receptor charge. Those skilled in the art will readily appreciate that fluid-disabling detonators such as those described in this last-mentioned patent to Swanson have been successfully used for more than thirty years.

Consideration has also been given to permanently disabling an explosive detonator that has been subjected to extreme ambient temperatures before it is actuated. For example, as disclosed in U.S. Pat. No. 2,363,254, the explosives in a detonator were at least partially enclosed in a protective sheath formed of a heat-sensitive composition which melts at temperatures greater than 140° F. (60° C.) and thereby permanently desensitizes the explosives as the compound is melted. U.S. Pat. No. 3,994,201 discloses an electrically-actuated explosive device in which a so-called meltable "stabilizing agent" such as a wax is either initially intermixed with one of the explosives or subsequently becomes mixed therewith so as to permanently disable the device whenever the explosive device is exposed to extreme ambient temperatures. An alternative embodiment is also shown in this last-mentioned patent of an explosive device having a fusible metal plug which melts when it is accidentally overheated so that the explosive will be drained from the device before it can be actuated. U.S. Pat. No. 3,774,541 also discloses techniques for deactivating an explosive device when a wax or other meltable solid positioned between the initiator and booster charges is heated above the melting point of the meltable material. That patent further describes how wax may be employed for selectively activating or deactivating an explosive device when it is exposed to various ambient temperatures.

It is, of course, essential to avoid inadvertent actuations of these wireline tools at the surface which may cause fatalities and injuries to personnel as well as damage to nearby equipment. One common source for the inadvertent actuation as a well tool operated by an electric detonator is the careless application of power to the cable conductors after the well tool is connected to the suspension cable. To at least minimize that risk, one common safety practice is to delay the installation of the detonator as well as the final connection of its electrical leads as long as possible. Further protection is often provided by controlling the surface power source by means of a key-operated switch which is not unlocked until the tool is at least at a safe depth in the well bore if not positioned at the depth interval where the tool is to be operated.

These safety procedures will, of course, greatly reduce the hazard of inadvertently detonating the explosive devices in these tools while they are still at the surface. Nevertheless, a major hazard is that the electric detonators commonly used for oilfield explosive tools are susceptible to being inadvertently detonated by strong electromagnetic fields. Another source of premature actuation of these detonators is the unpredictable presence of so-called "stray voltages" which may sporadically appear in the structural members of the drilling platform. Such stray voltages are not ordinarily present; but these voltages are often created by power generators on the drilling rig, cathodic protection systems for the structure or galvanic corrosion cells which may be present at various locations in the structure. Lightning may also set off these detonators. At times there may be hazardous voltage differences existing between the wellhead, the structure of the drilling rig and the equipment used to operate the tools.

Because of these potential hazards that exist once these tools have been armed, many proposals have been made heretofore for appropriate safeguards and precautions for handling these tools while they are at the surface. For instance, when a tool with an electric detonator is being prepared for lowering into a well, in keeping with the susceptibility of detonators to strong electromagnetic fields it is usually necessary to maintain strict radio silence in the vicinity. Ordinarily temporary restrictions on nearby radio transmissions will not represent a significant problem on a land rig. On the other hand, when a tool with an electric detonator is used on a drilling vessel or an offshore platform, it is a common practice to at least restrict, if not prohibit, radio and radar transmissions from the platform and any helicopters and surface vessels in the vicinity. Similarly, it may also be necessary to postpone welding operations on the rig or platform since welding machines may develop currents in the structure that may initiate a sensitive electric detonator in an unprotected well tool that is located at the surface.

It will, of course, be recognized that an inordinate amount of time is frequently lost when a well tool having electrically-actuated explosive devices is being prepared for operation since ancillary operations that are unrelated to the service operation are often curtailed. For example, the movements of personnel and equipment by helicopters and surface vessels must be restricted to avoid ratio and radar transmissions which might set off one of the detonators. Thus, when a service operation using explosive devices is being considered, it will be necessary to take into account the relative priorities of these several operations and the proposed well service operation to decide which activities must be curtailed in favor of the higher-priority tasks. These problems relating to the operations on one offshore rig may also similarly affect operations on nearby rigs. Accordingly, where there are a large number of platforms or drilling vessels in a limited geographical area, all of the activities in the area must be coordinated to properly accommodate the various operations in the affected area. These delays and related logistical problems will have obvious restrictive effects on the operations in that field.

In view of these problems, various proposals have been made heretofore to disarm these well tools by temporarily interrupting the explosive train between the initiating explosive device and the other explosive devices. It is, of course, recognized that by positioning a barrier formed of a dense substance, such as a rubber or metal plug, between the donor and receptor charges in a typical detonator will attenuate the detonation forces of the donor explosive sufficiently for reliably blocking the detonation of the receptor charge. For example, some commercial detonators are sold with rubber plugs disposed in the fluid-disabling ports that communicate to the empty space between the adjacent charges. This same principle is, of course, the basis for the utilization of the safe-arming barriers seen in U.S. Pat. No. 4,314,614 and FIG. 7 of U.S. Pat. No. 4,011,815. U.S. Pat. No. 4,523,650 shows a disarming device employing a rotatable barrier which is initially positioned for interposing a solid detonation-blocking wall between the donor and receptor explosives until the tool is ready to be lowered into the well bore. To arm that tool, the barrier is rotated to align a booster explosive in the barrier with the spaced donor and receptor explosives. With these prior-art devices, it is, of course, absolutely essential to remove or reposition those temporary barriers before the tool is lowered into the well bore so that it will thereafter be free to operate as well as properly function to allow any well liquids leaking into the enclosed tool body to effectively disable the detonator before the tool can be actuated. This, of course, means that once these prior-art temporary barriers have been repositioned or removed, the electric detonator in that well tool is thereafter subject to being inadvertently detonated by any of the extraneous hazards discussed above.

It must be kept in mind that these hazards will still be present when a well tool carrying a still-unfired detonator and one or more unexpended explosive devices is subsequently removed from a well bore. This situation itself represents a significant additional hazard since it is not always possible to know whether or not the detonator has been previously fired. Thus, there is a potential risk to personnel reinstalling these safety barriers after the tool has been returned to the surface. It should also be noted that personnel in the vicinity of the well will be aware of the potential danger when handling any tool with an unfired detonator. Accordingly, even a low-order detonation of explosive devices on a tool being retrieved from the well bore can be a significant problem since nearby personnel may easily overreact to the sudden noise and possibly injure themselves as well as damage equipment as they are seeking safety.

OBJECTS OF THE INVENTION

Accordingly, it is an object of the present invention to provide new and improved methods and apparatus for selectively enabling and disabling various well tools carrying one or more explosive devices which are initiated by electrical detonators.

It is a further object of the present invention to provide new and improved selectively-actuated explosive detonators that are unaffected by radio or radar signals or extraneous voltages.

It is an additional object of the invention to provide new and improved explosive detonators which can not be set off by spurious electrical energy and can be predictably and reliably employed with well tools which are carrying hazardous explosive or chemical devices that are selectively actuated by electrical detonators.

It is another object of the present invention to provide methods and apparatus for reliably and predictably rendering explosive devices inoperable until those explosive devices are exposed to predicted well bore conditions.

It is a further object of the present invention to provide methods and apparatus for enabling explosively-actuated well tools only when those tools have been exposed to predicted well bore temperatures for an extended time period and then reliably rendering the tools inoperable should the tools be subsequently returned to the surface without having been operated.

SUMMARY OF THE INVENTION

In one manner of achieving the objects of the invention, a body formed of a low-temperature fusible metal alloy having a selected melting point is operatively arranged between the donor and receptor explosives in a detonator for reliably blocking the transmission of detonation forces from the donor explosive to the receptor explosive until the detonator has been subjected to well bore temperatures greater than the melting point of the fusible alloy.

In another manner of attaining these and other objects of the present invention with a well tool carrying an explosive train comprised of a plurality of serially-arranged explosives, the detonation path of one of the explosives in the explosive train is initially blocked by a unique detonation barrier formed of a low-temperature fusible metal alloy having a predictable melting point and which is appropriately configured for reliably preventing the detonation forces of that explosive from setting off an adjacent explosive unless temperatures exterior of the well tool have heated the fusible alloy to its predetermined melting point. By selecting a fusible metal alloy which has a melting point less than the known temperatures of the well bore fluids, when the tool is exposed to those elevated temperatures, the barrier will be predictably transformed to its liquid state allowing the liquid alloy to flow to a non-blocking position away from the detonation path of the donor explosive and there will be no doubt that the barrier is no longer capable of attenuating the detonation forces of the donor explosive when it is detonated thereafter.

In yet another manner of carrying out the new and improved methods and apparatus of the invention, a barrier is formed of a fusible metal alloy which will remain solid below a predetermined melting point is initially positioned in the body of a detonator in the detonation path of a donor explosive to prevent it from setting off an adjacent receptor explosive in the body of the detonator. The barrier will reliably safeguard the receptor explosive against unwanted detonation until such time that the fusible alloy forming the barrier is predictably transformed to its liquid state. In one embodiment of the present invention, the detonator is armed by allowing the liquified fusible alloy to flow away from its detonation-blocking position between the donor and receptor explosives. As an additional safeguard against the inadvertent detonation of the receptor explosive should the donor explosive not be detonated, in one way of practicing the methods and apparatus of the invention means are provided to return the fluent fusible metal alloy to its initial detonation-blocking position between the explosives so that the fusible metal alloy will again provide an effective barrier for reliably preventing the detonation of the receptor explosive as the well tool is subsequently recovered from the well bore.

BRIEF DESCRIPTION OF THE DRAWINGS

The novel features of the present invention are set forth with particularity in the appended claims. The invention along with still other objects and additional advantages thereof may be best understood by way of exemplary methods and apparatus which employ the principles of the invention as best illustrated in the accompanying drawings in which:

FIG. 1 schematically depicts a wireline tool having an electrically-actuated detonating system including a detonator arranged in accordance with the principles of the invention for reliably disabling the tool while practicing the methods of the invention;

FIG. 2 is an enlarged elevational view of an electric detonator which is suitable for use in the wireline tool seen in FIG. 1 and illustrates one preferred embodiment of new and improved detonation-blocking means cooperatively arranged for reliably disabling the detonator in keeping with the principles of the invention;

FIG. 3 is a transverse cross-sectional view taken along the line "3—3" in FIG. 2;

FIG. 4 is an enlarged elevational view of a conventional detonating cord union that has been specially arranged in keeping with the principles of the present invention to provide a second embodiment of new and improved detonation-blocking means;

DESCRIPTION OF A PREFERRED EMBODIMENT OF THE INVENTION

Figure 5:
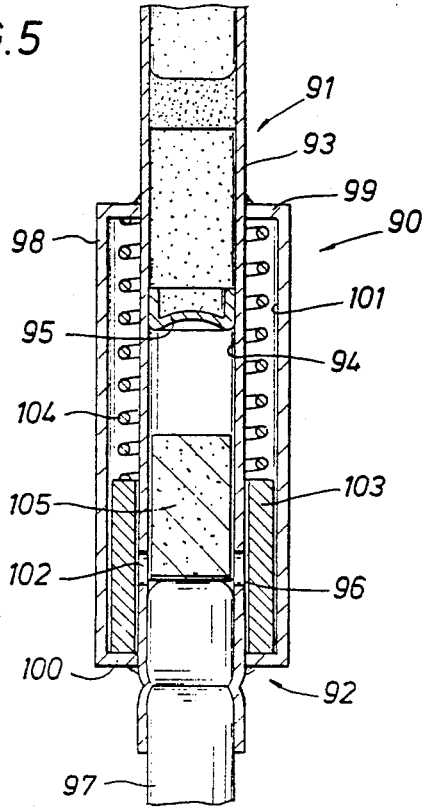
FIG. 5 is a cross-sectioned elevational view illustrating a third preferred embodiment of detonation-blocking means of the present invention cooperatively arranged on a typical electric detonator for reliably disabling the detonator until it has been exposed to a predetermined well bore temperature.

Turning now to FIG. 1, a new and improved detonator 10 arranged in accordance with the principles of the invention is shown as this detonator would be utilized to reliably control from the surface a typical wireline tool 11 carrying explosive devices. As will subsequently become apparent, the detonator 10 is effective to selectively fire from the surface one or more explosive devices on any one of the well tools discussed above such as an otherwise-typical perforating gun 11 illustrated in the drawings. It is to be understood, however, that the new and improved detonator 10 of the present invention is not restricted to use with only certain types of perforators much less limited to any particular type of well tool with one or more explosive devices.

As illustrated, the perforator 11 is dependently connected to the lower end of a typical suspension cable 12 spooled on a winch (not shown in the drawings) at the surface and which is selectively operated as needed for moving the tool through a casing 13 secured within a borehole 14 by a column of cement 15. The perforating tool 11 is dependently coupled to the lower end of the suspension cable 12 by means of a rope socket 16 which facilitates the connection of the conductors of the cable to the new and improved selectively-armed detonator 10 of the present invention. The perforator 11 is also coupled to a typical collar locator 17 connected by way of the conductors in the suspension cable 12 to surface instrumentation (not shown in the drawings) to provide characteristic signals which are representative of the depth location of the tool as it passes the collars in the casing string 13. As depicted in FIG. 1, the perforating tool 11 is a typical hollow-carrier perforator carrying a plurality of shaped explosive charges 18 respectively mounted at spaced intervals in an elongated fluid-tight carrier 19. To selectively detonate the charges 18, one end of a typical detonating cord 20 of a suitable secondary explosive, such as RDX or PETN, is operatively coupled to the detonator 10 and the core is extended through the carrier 19 and cooperatively positioned in detonating proximity of each of the several shaped charges.

Turning now to FIG. 2, a preferred embodiment of the new and improved detonator 10 which is arranged in accordance with the principles of the present invention is depicted as being a commercial electric detonator (such as those currently offered for sale by DuPont as its E-84 or E-85 fluid-disabled detonators) which is specially designed for actuating explosive devices in enclosed well bore tools. As depicted in FIG. 2, the detonator 10 includes a donor charge 21 which is comprised of an explosive primer charge 22 of lead azide or other primary explosive and a booster or base charge of RDX or other secondary explosive 23 which are serially arranged in the upper portion of an elongated tubular metal shell 24 and encapsulated therein by a fluid-tight intermediate partition 25. Electrical leads 26 are disposed in the upper end of the shell 24 and connected to the opposite ends of an electrical bridge wire 27 arranged to set off a typical igniting explosive 28 disposed in the upper portion of the shell 24 within detonating proximity of the primer explosive 22. To protect the donor charge 21 from well bore fluids, the leads 26 are fluidly sealed in the upper end of the tubular shell 24 by means such as a rubber plug 29.

The detonator 10 further includes a receptor charge 30 that is enclosed in a hollow metal shell 31 having a closed upper end 32 which is dependently coupled to the upper donor charge 21 by being snugly fitted and secured, as by crimping, into the lower portion of an elongated tubular sleeve 33 preferably represented by a depending integral extension of the tubular shell 24. In the illustrated commercial detonator, the receptor charge 30 also includes a primer charge 34 of a suitable primary explosive, such as lead azide, disposed in the upper portion of the lower shell 31 adjacent to a booster charge 35 of a secondary explosive such as RDX. As is typical, the lower shell 31 includes a depending tubular portion 36 which is cooperatively sized to snugly receive one end of an elongated detonating cord, such as shown at 20 in FIG. 1, and retain it in detonating proximity of the booster charge 35.

It will, of course, be appreciated that a fluid-disabled detonator (such as the DuPont E-84 or E-85 detonator) as at 10 is cooperatively arranged for the donor charge 21 to detonate the receptor charge 30 so long as there is no substantial obstruction in the detonation path of the donor charge that is defined by the longitudinal bore in the tubular sleeve 33 between the charges. Accordingly, as described in the Swanson patent (U.S. Pat. No. 2,891,477), high-order detonation of the donor charge 21 will be effective for reliably detonating the receptor charge 30 so long as the intervening space between the charges remains relatively unobstructed thereby facilitating the effective propagation of the detonation wave from the donor charge to the impact-sensitive receptor charge. Thus, the detonator 10 will be operative only so long as the carrier 19 is fluid tight so that the interior of the carrier as well as the intervening space in the sleeve 33 are air-filled. On the other hand, the length of the tubular sleeve is designed to separate the charges 21 and 30 sufficiently to insure that the detonation forces of the donor charge 21 can not set off the receptor charge 30 when a significant quantity of a well bore liquid has entered the intervening space in the sleeve 33 by way of the upper and lower leakage ports 37 and 38. Thus, by positioning the detonator 10 in the lower end of the carrier, the detonator will be disabled should an excessive quantity of well bore liquids leak into the carrier 19 and rise to the level of the detonator. In this manner, the more-powerful explosive devices in the explosive train represented by the detonating cord 20 and the shaped charges 18 will not be detonated since liquids in the sleeve 33 will block detonation of the receptor charge 30 even if the donor charge 21 is fired.

In keeping with the principles of the present invention, it has been found that a detonator such as the one shown at 10 can be selectively disabled by installing a unique detonating barrier of a low-temperature fusible metal alloy in the detonation path of its donor charge, such as at 21, for reliably attenuating the detonation forces of the donor charge. With this unique barrier, the detonator 10 will not be operative until it is subjected to well bore temperatures greater than the selected melting point of the fusible alloy for a sufficient time period that the fusible alloy will be melted. As will be subsequently discussed, the detonation barrier is operatively sized to reliably prevent the detonation of the donor charge 21 from setting off the receptor charge 30 until elevated well bore temperatures exterior of the tool 11 greater than the melting point of the selected fusible alloy have predictably and reliably transformed the barrier to a liquid state. Once the melted alloy is no longer blocking the detonation path of the donor charge 21, there will be no further attenuation of the detonating forces of the donor charge.

With the detonator 10 illustrated in FIG. 2, this unique disabling function of the present invention is carried out by substantially obstructing the longitudinal passage in the tubular sleeve with barrier means such as an elongated rod 39 formed of a selected low-temperature fusible metal alloy disposed into the aligned upper holes 37 on opposite sides of the sleeve 33. If desired, a second barrier member 40 may also be installed into the lower holes 38 in the sleeve 33 to provide greater assurance that the receptor charge 30 can not be detonated. It will, of course, be appreciated that since the barrier rods 39 and 40 can be sized to fit the holes 37 and 38 the unique disabling function of the present invention is safely carried out without modifying the commercial detonator.

As best depicted in FIG. 3, the barrier rods 39 and 40 are preferably secured in their detonation-blocking positions by one or more retainers such as cotter pins 41 and 42 in lateral holes in the end portions of the barrier members. The barrier rods 39 and 40 could instead by configured with an enlarged head on one end so that a pin in the small-diameter end portion of each rod will secure the rods once they are installed. It should, of course, be appreciated that it is only the intermediate potions of the barrier rods 39 and 40 spanning the bore of the tubular sleeve 33 which are effective for blocking the detonation forces of the donor charge 21. Thus, if desired, the barrier rods 39 and 40 could be alternatively arranged with their intermediate portions of selected fusible alloys should it be considered to be advantageous to construct the end portions of the barrier members of dissimilar materials.

In the particular commercial detonator 10 illustrated in FIG. 2 (i.e., the DuPont E-84 model), the diameter of the holes 37 and 38 in the sleeve 33 is 0.125-inch, the internal diameter of the tubular sleeve is 0.24-inch, and the spacing between the holes 37 and 38 is 0.875-inch. With this particular detonator 10, it was found that the detonator was effectively disabled by inserting only a single rod 39 having a diameter slightly less than 0.125-inch through the upper holes 37 in the sleeve 33 for blocking the detonation path of the donor charge 21 through the longitudinal bore of the sleeve. Nevertheless, it is preferred to dispose the barrier rod 40 (identical to the rod 39) through the lower holes 38. As illustrated in FIG. 3, it will be seen that since the barrier rods 39 and 40 are in perpendicularly-intersecting longitudinal planes arranged along the central axis of the sleeve 33, the detonation path of the donor explosive 21 is substantially blocked so that very little, if any, of the detonation forces propagated by the donor explosive will reach the receptor charge 30. Hereagain, it must be emphasized that in the practice of the present invention it is not necessary to make modifications to a commercial detonator such as the detonator 10 in order to safeguard it from being set off by spurious electric signals or inadvertent application of power to igniter bridge wire 27. The safety considerations which this represents are, of course, readily apparent.

Those skilled in the art will recognize, of course, that if the design of a given detonator is appropriate, effective barrier members can be arranged for accommodating other configurations of detonators that have spaced donor and receptor explosives that are separated by a defined detonation path. Nevertheless, in the preferred manner of practicing the invention with detonators such as the commercial detonator shown at 10, the illustrated rods 39 and 40 are considered the most-effective configuration for the barrier means of the present invention inasmuch as these selected fusible metal alloys can be inexpensively and easily cast into cylindrical rods or other shapes which can be readily prepared as needed for installation in any detonator without having to modify the detonator. Typical testing procedures will, of course, be required to establish the sizes of barrier members which are considered suitable for reliably and selectively disabling other styles or models of particular detonators. Accordingly, it will be understood that the invention is not to be construed as being restricted to barriers of any particular dimension or shape.

The most-important function of the barrier members 39 and 40 is, of course, to reliably disable the detonator 10 so that the receptor charge 30 can not be set off should the donor charge 21 be inadvertently or prematurely detonated. Thus, it is essential that the barrier members 39 and 40 be formed of a selected alloy which will reliably remain in a solid state until the perforator 11 has been safely positioned in the well bore. Nevertheless, in the successful practice of the invention, it is equally important that the barrier members 39 and 40 will also reliably respond to a predictable event and thereafter no longer function to disable the detonator 10. Accordingly, the fusible metal alloy which is employed for a particular pair of the barrier members 39 and 40 will be an alloy having a melting point less than the temperature of the well bore fluids at the particular depth interval where the perforator 11 is to be operated.

In the preferred practice of the invention, a plurality of barrier members, as at 39 and 40, of appropriate dimensions are prepared in advance from various compositions of fusible metal alloys which are respectively selected to have different melting points spread over a desired range of temperatures. In this way, a set of barrier members, as at 39 and 40, of different selected temperature ratings will be provided to enable the perforator 11 to be operated reliably at various well bore temperatures. The selection of the specific barrier members which are to be used for a given operation with the perforation 11 will, of course, be made in accordance with the well bore temperature conditions that the perforator might encounter during a particular forthcoming operation. Once those temperature conditions are established, a selected set of the barrier members 39 and 40 respectively having a melting point of a slightly lower temperature than the expected well bore temperature will be installed in the detonator 10 while the perforator 11 is being prepared for operation. Even if the well bore temperatures are not known in advance, the service crew can defer the installation of barrier members with appropriate temperature ratings until the actual temperature conditions are determined. It will be appreciated that the safest procedure is to always have the barrier members 39 and 40 in the detonator 10 regardless of their temperature rating. Then, when the barrier members 39 and 40 are being replaced with other barrier members having the correct temperature rating, there will always be at least one barrier member safeguarding the detonator 10 while the barrier members are being interchanged.

In any event, once the barrier members 39 and 40 which have the appropriate temperature rating are installed, the perforator 11 will be reliably disabled until the perforator is lowered into the well bore. Should there be a spurious electrical signal that prematurely detonates the donor charge 21, the barrier members 39 and 40 will prevent the booster charge 30 from detonating whether the perforator 11 is at the surface or is in the well bore. If a major quantity of liquids leak into the perforator 11 while it is in the well bore, the fluid-disabling feature of the detonator 10 will reliably prevent the donor charge 21 from setting off the receptor charge 30. Accordingly, it will be appreciated that by virtue of the installation of the barrier members 39 and 40 in an otherwise-typical fluid-disabling detonator, such as shown at 10, the perforator 11 will be reliably safeguarded against premature detonations for any reason.

It must be recognized, therefore, that because of the unique intrinsic nature of the fusible alloys used to form the barriers 39 and 40, it can be accurately predicted that the perforator 11 will be safely disarmed until it has been exposed to a known well bore temperature for a reasonable period of time. Those skilled in the art will appreciate the importance of the reliability and predictability of the disarming function of these barrier members 30 and 40. It will also be appreciated that it is also of major importance to know that the perforator 11 will be armed and ready for its intended operation once it has been exposed to a selected well bore temperature for a reasonable period of time. It will be recognized, therefore, that unless a significant quantity of well bore fluids have leaked into the perforator 11, the barrier members 39 and 40 will function to reliably arm the perforator for its intended operation once it is positioned at a desired depth interval. Hereagain, the predictability as well as the reliability this enabling feature of the barrier members of the present invention can not be underestimated any more than the initial disabling feature of the barrier members 39 and 40.

There are a variety of eutectic and non-eutectic fusible metal alloys that can be utilized in the practice of the present invention which are the various binary, ternary, quaternary and quinary mixtures of bismuth, lead, tin, cadmium and indium or other metals. When these fusible metals are eutectic alloys, the mixture has the unusual property of having a melting point lower than the lowest melting point for any of its constituents. This intrinsic melting point will be constant and, therefore, will be a precisely known temperature. Another unusual feature of any eutectic alloy is that its melting point is also its freezing point so that there is no freezing range between the liquid state and the solid state of the alloy. In other words, a solid body of any eutectic alloy is immediately converted to a liquid once that body reaches its intrinsic melting point. The fluidity of these liquid eutectic alloys is similar to the fluidity of liquid mercury at room temperature. Assuming that the detonator 10 is properly positioned in the carrier 11, once the barrier members 39 and 40 have been melted, the liquified barrier members will simply flow out of the tubular sleeve 33 and thereby immediately remove the safeguarding obstruction in the detonation path of the donor charge 21. Hereagain, it should be appreciated that by virtue of this intrinsic melting point of a particular fusible metal alloy being used, the barrier members will uniquely serve to reliably and predictably safeguard a detonator, such as the fluid-disabled detonator 10, against premature actuation as well as uniquely serve to reliably and predictably arm the perforator 11 once the barrier is heated to that known melting point.

There are a variety of eutectic fusible alloys of bismuth with melting points that range all the way from 117° F. to 477° F. (46.8° C. to 247° C.). Those skilled in the art will appreciate, however, that ordinarily the well bore temperatures at the usual depths of most well service operations will be no more than about 300° F. (138° C.). As a practical matter, therefore, there is a group of seven eutectic alloys with melting points between 117° F. and 255° F. (46.8° C. to 124° C.) that are considered to be the most useful fusible metals for practicing the methods and apparatus of the present invention. Although standard handbooks of metallurgy will give the precise compositions for these seven bismuth alloys that will ideally serve for providing detonation barriers of the present invention, the eutectic alloy which is best suited for operation in most wells has a melting point of only 117° F. and is composed of 44.7% bismuth, 22.6% lead, 8.3% tin, 5.3% cadmium and 19.1% indium. The eutectic alloy which has the highest melting point of 255° F. is composed of 55.5% bismuth and 44.5% lead. The other five bismuth eutectic alloys in the group are each composed of varying amounts of the above-named alloys respectively having melting points falling between these two temperature limits. In any case, in the practice of the invention, at least one of these seven alloys will provide a reliable and predictable detonation barrier.

By virtue of the foregoing discussion of the principles of the present invention, those skilled in the art will, of course, appreciate that there are also non-eutectic fusible alloys which may be successfully employed in the practice of the invention. Instead of having precise melting points and an immediate change from the solid state to the liquid state, the non-eutectic alloys have a moderate range of melting points and their intermediate state is similar to slush as the alloy is heated from the lower limit of its melting range to the upper limit of that range. For instance, one common non-eutectic fusible metal alloy is composed of 50.5% bismuth, 27.8% lead, 12.4% tin and 9.3% cadmium and has an intrinsic melting range of 158° F. to 163° F. (i.e., 70.5° C. to 72.5° C.). With other non-eutectic alloys in the same family, decreases in the percentage of bismuth to 35.1% and increases of the percentage of lead to 36.4% will result in a group of fusible metals with a range of melting points between the lower limit of 158° F. and progressively-higher upper limits up to 214° F. (111° C.). A second low-temperature non-eutectic alloy which can be utilized is composed of 42.9% bismuth, 21.7% lead, 7.97% tin, 18.33 indium and 4.00% mercury. This latter non-eutectic alloy has a range of melting points between 100° F. to 110° F. (37.8° C. to 43.3° C.). It is, of course, readily apparent that the melting range of this second non-eutectic alloy is so low that this alloy could be used in any well. Moreover, the first-mentioned non-eutectic alloy having the lower range of 158° F. to 163° F. could be utilized in most well bore situations to provide a reliable and predictable detonation barrier. Hereagain, it must be kept in mind that the paramount purpose of the invention is to provide detonation barriers having reliable and predictable disabling features as well as enabling features. Thus, there could well be various situations where the well bore temperatures are so hot that those non-eutectic fusible alloys with wider ranges of melting temperatures can be utilized as well in order to provide sufficiently reliable and predictable barrier members. The important thing is that the melting point of a given fusible metal is an intrinsic property whether that metal is a eutectic alloy having a single melting point of a known value or is a non-eutectic alloy which has a defined range of melting temperatures. In either case, it is the intrinsic melting temperatures of these fusible alloys which provide the reliability and predictability features of the new and improved barrier means of the invention.

Turning now to FIG. 4, a second detonator 60 which is also arranged in accordance with the principles of the invention is depicted to show still another example of effective utilization of the detonation barriers of the invention. The detonator 60 is arranged as a so-called "detonating cord union" having a tubular body 61 with encapsulated booster charges 62 and 63 respectively arranged on the opposite ends of the tubular body and spatially disposed from one another to define an empty intermediate portion 64 in the tubular body. It should be noted that the detonating cord union 60 is depicted as having a unitary tubular member for the body 61 with the charges 62 and 63 disposed in its opposite end portions but the detonator could be alternatively constructed by securing commercial booster charges in the opposite ends of a tube by means of a suitable PVC adhesive. That alternative would allow the detonator 60 to be assembled from commercial off-the-shelf components without unduly risking the accidental detonation of the charges 62 or 63 by mechanically crimping the charges into place within the tubular body 61.

In the particular detonating cord union depicted at 60, the booster charges 62 and 63 are respectively arranged to include a primary explosive 65 and 66 and a secondary explosive 67 and 68 positioned in the end portions of the tubular body 61. The ends of the body 61 are extended for respectively receiving the ends of detonating cores 69 and 70 which are crimped in the tubular extensions of the body 61. As is typical, the booster charges 62 and 63 are arranged so that the primary explosives 65 and 66 are facing one another on opposite ends of the intermediate space 64 to make the illustrated detonating cord union 60 bidirectional. In other words, by cooperatively arranging the detonating cord union 60 to be bidirectional, it is capable of transferring the detonating force of the detonating cord 69 to the detonating cord 70 as well as transferring the detonating force of the detonating cord 70 to the detonating cord 69. This, of course, means that in any given situation one of the two booster charges (62 or 63) will be the donor explosive in the depicted detonator 60 and the other booster (62 or 63) will serve as the receptor explosive.

In keeping with the principles of the invention, the sleeve 61 is manufactured to provide an elongated window 71 in one side of the tubular sleeve which is appropriately sized to enable an elongated detonation barrier 72 of a fusible metal alloy to be conveniently inserted into the tubular sleeve. The fusible metal alloy to be used for the barrier 72 is, of course, selected in accordance with the previous discussion. A suitable retaining member such as tape or a band 73 is arranged for securing the elongated barrier 72 in its illustrated upright position within the tubular sleeve 61. It will, of course, be appreciated that so long as the elongated barrier is disposed within the tubular sleeve 61, the barrier 72 will reliably prevent the unwanted detonation of the donor charge (for example the booster 63) if the receptor charge (for example the booster 62) be inadvertently detonated before the barrier has been melted. Fluid ports are obviously not required since the window 71 allows any well fluids that may have leaked into the enclosed carrier (such as at 19) to enter the tubular sleeve 61 and block the detonation paths of the booster charges 62 and 63. With respect to the detonator 60, it was found that with a length of at least 0.25-inch, the upright barrier 72 safeguarded boosters with equivalent explosive power as the DuPont E-84 and E-85 detonators. It was also found that further safety is provided by forming the barrier 72 and the complemental bore portion of the sleeve 61 receiving the barrier with a slight taper (i.e., in the order of only 3–6 degrees) that prevents the solid barrier from being driven toward the receptor charge (i.e., the booster charge 63) if the donor charge (i.e., the booster charge 62) is accidentally set off. Routine tests will be needed to arrive at an appropriate size for a barrier, as at 72, capable of reliably disabling detonators which are similar to the detonating cord union 60 but have different explosives.

It will be appreciated that detonating cord unions, such as at 60, are typically employed for detonating a second series of explosive charges after a first set of charges have been fired. Arrangements of serially-coupled detonating cords and unions are, of course, commonly employed for firing tandemly-interconnected wireline perforators as well as tubing-conveyed perforators or so-called "TCP" perforators. Hereagain, typical routine tests will be need to arrive at an appropriate size for the barrier 72 that will reliably disable other detonation cord unions which are also arranged in accordance with the principles of the invention. It should be noted that ordinarily a detonating cord union, as shown at 60, is not a fluid-disabled detonator since it is not usually positioned in the lower end of a particular carrier. If fluid-disabling is needed for a given perforator, it would, of course, be necessary to have at least one detonator in that perforator that would be a fluid-disabling detonator. That is, however, a choice that is outside of the scope of the present invention.

From the preceding descriptions of the detonators 10 and 60, it will be recognized that although each of these detonators is uniquely capable of preventing the inadvertent detonation of its donor charge from setting off its associated receptor charge, the perforator 11 will become permanently armed once the fusible metal barrier in that detonator is melted. Ordinarily it is of no consequence that the perforator 11 is armed at some safe depth in a well bore since the perforator will typically be fired once it is properly positioned in the well bore. Nevertheless, those skilled in the art will recognize that, at times, a well tool such as the perforator 11 must be returned to the surface without having detonated the explosives carried by that tool. Moreover, it is not too uncommon for a well tool such as the perforator 11 to be returned to the surface without realizing that an unnoticed or unknown malfunction kept the explosives from being detonated as planned. In either situation, it is always considered risky to retrieve an armed well tool such as the perforator 11 to the surface.

Accordingly, turning not to FIG. 5, a third detonator 90 which is cooperatively arranged in accordance with the principles of the invention is depicted to show how the detonation barriers of the invention can be utilized for reliably safeguarding a well tool such as the perforator 11 as it is being lowered into a well bore as well as when the perforator is being recovered with an unfired detonator. As depicted, the detonator 90 preferably includes an appropriately-matched set of encapsulated explosive charges 91 and 92 respectively arranged on opposite ends of an elongated tubular body 93 for spatially separating the opposing ends of the charges by an air-filled chamber 94 defined in the intermediate portion of the elongated body either by the opposed ends of the encapsulated charges or by spatially-disposed upper and lower transverse partitions 95 and 96 in the tubular body.

It will be appreciated that the charges 91 and 92 can be respectively arranged with various combinations of primary and secondary explosives in sufficient quantities to be certain that the high-order detonation of one of the encapsulated charges will reliably set off the other encapsulated charge if the air-filled chamber 94 is not substantially obstructed. Moreover, it will be realized that it is immaterial to the practice of the invention which of the two encapsulated charges 91 and 92 is the donor charge and which one is the receptor charge. The detonator 90 may be arranged either as a uni-directional detonator or as a bi-directional detonator. Similarly, it is equally unimportant to an understanding of the invention how the donor charge in this depicted combination of encapsulated charges is to be set off. Thus, if the charge 91 is the donor charge in the detonator 90, the charge 91 may be an electrically-initiated detonator (as illustrated) or it may be a passive charge which is to be set off by a detonating cord (not depicted in the drawings). Likewise, it is assumed that the charge 92 is to be the receptor charge in the illustrated assembly of charges, it is immaterial what other explosive devices (not illustrated in the drawings) have been positioned in detonating proximity of that charge. Accordingly, strictly for purposes of describing the function and operation of the unique detonator 90, the charge 91 will be characterized as the donor charge and the charge 92 will be characterized as the receptor charge in the illustrated explosive train which is to be utilized for setting off an explosive device such as a detonating cord 97.

The new and improved detonator 90 includes an enlarged-diameter tubular shell 98 which is coaxially arranged around the elongated tubular member 93 and closed at its upper and lower ends by annular end plates 99 and 100 respectively sealed to the tubular member (as by a seal weld) to define an enclosed annular chamber 101 around the inner chamber 94. Fluid communication between the inner and outer chambers 94 and 101 is provided by one or more lateral ports, as at 102, in the elongated tubular member 93 at a level that is substantially flush with the upper surface of the lower partition 96. It will be appreciated from FIG. 5 that the lower partition 96 is at a higher level than the lower end plate 100.

An annular displacement member 103 is movably arranged in the outer annular chamber 101 and cooperatively arranged to be normally retained in its depicted lower position by temperature-responsive biasing means such as a coiled actuator 104 of a so-called "shape memory metal" having a "two-way memory" such as the alloys presently manufactured by Memory Metals Inc. of Stamford, Conn., and presently marketed under the trademark Memrytec. Complete descriptions of these Memrytec alloys and typical fabrication techniques are fully described in a technical article on page 31 of the July, 1984, issue of the periodical ROBOTICS AGE entitled: "Shape Memory Effect Alloys for Robotic Devices" as well as in a brochure put out by Memory Metals Inc. entitled: "An Introduction to Memrytec Shape Memory Alloys as Engineering Materials" dated in 1986. As will be explained in more detail subsequently, the coiled actuator 104 is fabricated to remain in its depicted extended position at ambient temperatures and to be contracted in response to higher exterior temperatures. The upper and lower ends of the actuator 104 are respectively coupled between the end plate 99 and the displacement member 103 for selectively moving the displacement member upwardly to an elevated position in the outer chamber 101 when the actuator is being contracted and for selectively moving the displacement member downwardly to its illustrated lower position as the actuator is being extended.

An upright barrier member 105 formed of a selected fusible alloy is disposed in the inner chamber 94. In keeping with the principles of the invention, the fusible metal alloy is chosen so that the barrier member 105 will remain in its normal solid state until the detonator 90 is subjected to the elevated temperatures of well bore fluids. It will, of course, be recognized that the coiled actuator 104 is also responsive to the same elevated well bore temperatures. As will be subsequently explained, in the preferred practice of the invention, the operating temperatures of the coiled actuator 104 and the barrier 105 are respectively coordinated that the barrier member will become liquified before the coiled actuator operates.

Figure 6:
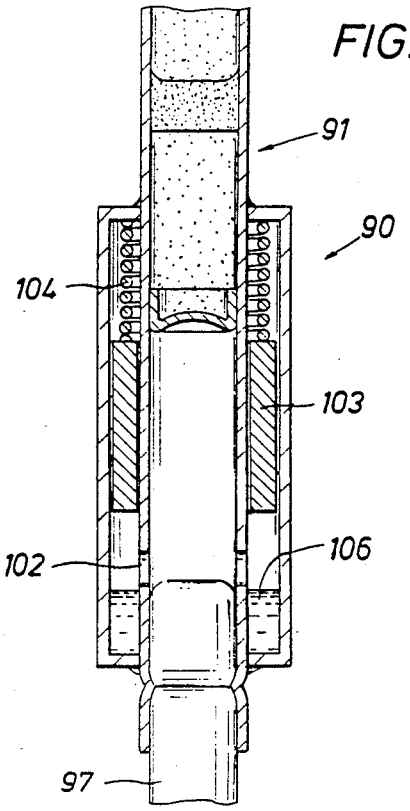
FIG. 6 is a cross-sectioned elevational view of the new and improved detonation-blocking apparatus depicted in FIG. 5 as the apparatus will typically appear after sustained exposure to a known elevated temperature.

Turning now to FIG. 6, the detonator 90 is depicted as it will appear when the well temperatures exterior of the detonator have been at an elevated level for a sufficient length of time to melt the fusible alloy forming the barrier member 105 and to move the coiled actuator 104 to its contracted position representative of that elevated temperature. As the temperature-induced biasing force of the coiled actuator 104 shifted the displacement member 103 to its illustrated elevated position, the side ports 102 were progressively opened to enable the liquified metal 106 produced upon melting of the barrier 105 to flow out of the inner chamber 94 and enter the outer chamber 101. It will be recognized that once the liquified fusible metal alloy 106 is discharged into the outer chamber 101, the detonation path defined within the inner chamber 94 in the tubular member 93 will then be unobstructed so as to permit the donor charge 91 to be subsequently detonated when it is desired to set off the receptor charge 92 in order to selectively actuate the well tool. Hereagain, as previously discussed, the particular arrangement of the explosive charges 91 and 92 is independent of the respective coordinated temperature-responsive actions of the displacement member 103 and the barrier means 105 in the new and improved detonator 90. Similarly, the manner in which the detonator 90 is actuated from the surface is unrelated to the practice of the invention. In any event, once the barrier member 105 has melted and the liquified metal 106 has flowed into the outer chamber 101, the well tool utilizing the detonator 90 is then armed and the detonator is readied for selective actuation from the surface by whatever means are to be used to set off the donor charge 91.

Figure 7:
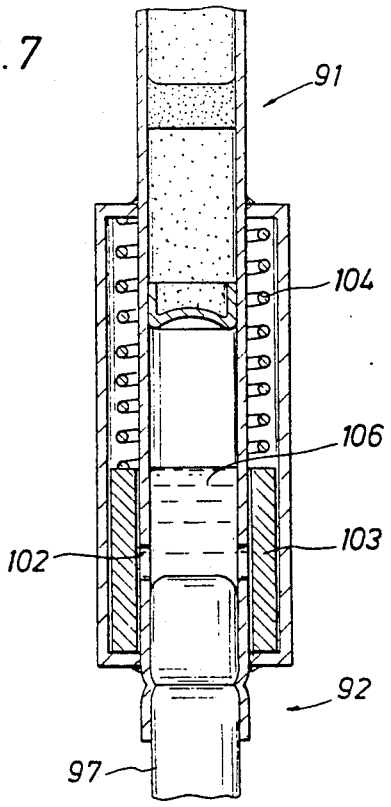
FIG. 7 is a cross-sectioned view similar to FIGS. 5 and 6 but illustrating the new and improved detonation-blocking means of the present invention as it is being subsequently returned to the surface without the detonator having been actuated.

As previously discussed, at times it may be necessary to recover a well tool such as the perforator 11 with an unexpanded detonator and there is a distinct risk that the detonator may be inadvertently detonated after the tool has been removed from the well bore. Accordingly, as shown in FIG. 7, the detonator 90 is depicted as it may appear as the tool is being returned to the surface and the progressive reductions in well bore temperatures exterior of the detonator have been effective for returning the coiled actuator 104 to its "remembered" initial position. At that lower temperature level, the actuator 104 will cooperatively function to restore the displacement member to its initial lower position and the resulting downward travel of the member 103 will be operative for displacing the still-liquified metal 106 (which came from the melted barrier member 105) out of the outer chamber 101 and though the ports 102 into the inner chamber 94. Since the ports 102 are flush with the lower partition 96, once the displacement member 103 has been returned to its initial lower position most, if not all, of the liquified metal 106 will have been displaced into the inner chamber 94. Once this liquified metal 106 has returned to the inner chamber 94, this liquified metal alloy which previously formed the barrier member 105 will resolidify at some point as the tool carrying the detonator 90 encounters cooler well bore fluids in the well bore. It will, of course, be appreciated that the presence of the fusible metal in the inner chamber 94 will be effective for permanently disabling the detonator 90 whether or not this fusible metal has had time to resolidify and recreate the previous barrier member 105. In any case, the recreated barrier member 105 will ultimately become solidified by the time that the well tool 11 is removed from the well bore.

In selecting the respective operating temperatures for the coiled actuator 104 and the barrier member 105, the only criteria will be to be certain that the melting point of the fusible alloy in the barrier member is lower than the "memory" temperature at which the actuator reverts to its original configuration. Since the melting point of the fusible alloy is precisely known if the metal is a eutectic alloy, there is no problem in establishing this lower temperature. Similarly, since the shape memory alloys which can be typically utilized for the actuator 104 also have fairly-well defined temperature limits, there will be a variety of these alloys that can be selected.

In keeping with the above-described prior-art practice of disabling explosive charges should well bore liquids leak into a fluidly-sealed well tool (such as the perforator 11) carrying the detonator 90, inner and outer ports (not illustrated) can be arranged on the inner and outer tubular members 93 and 98 to enable well bore fluids which leak into the sealed tool body to enter the inner space 94 and disable the detonator 90. These ports will not be required if the detonator 90 does not need this fluid-disabling feature.

Figure 8:
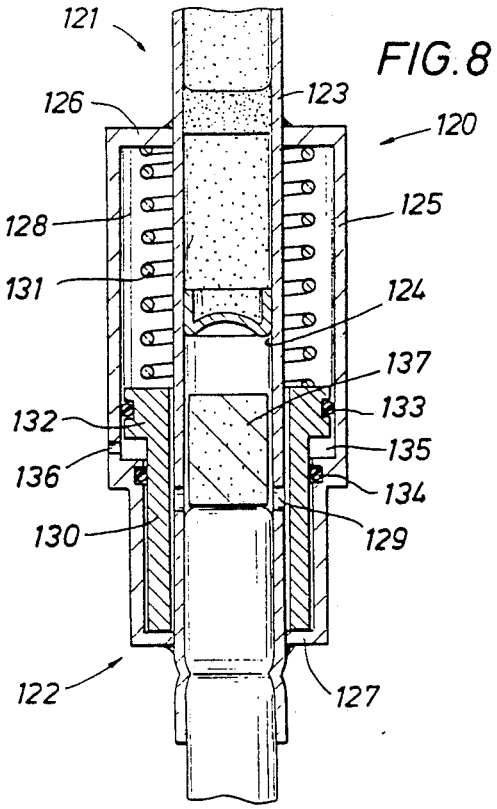
FIG. 8 is a cross-sectioned elevational view illustrating a fourth preferred embodiment of detonation-blocking means of the present invention cooperatively arranged on a typical electric detonator for reliably disabling the detonator until it has been exposed to a predetermined well bore pressure.

Turning now to FIG. 8, a fourth detonator 120 is depicted which is essentially similar to the detonator 90 in that this fourth detonator is also cooperatively arranged in accordance with the principles of the invention for using the detonation barriers of the invention to reliably safeguard a well tool such as the perforator 11 as it is being lowered into a well bore as well as when the perforator is being recovered with an unfired detonator. As depicted, the detonator 120 preferably includes an appropriately-matched set of encapsulated explosive charges 121 and 122 respectively arranged on opposite ends of an elongated tubular body 123 for spatially separating the opposing ends of the charges by an air-filled chamber 124 in the intermediate portion of the elongated body.

As previously mentioned with respect to the detonator 90, it will be appreciated that the charges 121 and 122 can be arranged as needed to be certain that the high-order detonation of one of the charges will reliably set off the other charge if the air-filled chamber 124 is not obstructed. Moreover, it is immaterial which of the charges 121 and 122 is the donor charge and which is the receptor charge for a given operation. The detonator 120 may also be arranged either as a uni-directional or a bi-directional detonator. Similarly, it is unimportant how the donor charge in this depicted combination of charges is to be set off. Thus, if the charge 121 is the donor charge in the detonator 120, the charge 121 may be an electrically-initiated explosive or it may be a passive charge which is to be set off by a detonating cord (not illustrated in the drawings). Likewise, if the charge 122 is to be the receptor charge, it is immaterial if other explosive devices have been positioned in detonating proximity of that charge. Accordingly, to describe the function and operation of the unique detonator 120, the charge 121 will be characterized as being the donor charge and the charge 122 will be characterized as being the receptor charge in the illustrated explosive train.

The new and improved detonator 120 includes an enlarged-diameter tubular shell 125 which is coaxially arranged around the elongated tubular member 123 and closed at its upper and lower ends by annular end plates 126 and 127 respectively sealed to the tubular member to define an enclosed annular chamber 128 around the inner chamber 124. Fluid communication between the inner and outer chambers 124 and 128 is provided by lateral ports, as at 129, in the tubular member 123 at a level that is substantially flush with the lower end of the inner chamber 124 as defined by the upper end of the charge 122.

An annular displacement member 130 is movably arranged in the outer annular chamber 128 and cooperatively arranged to be normally retained in its depicted lower position by biasing means such as a typical coil spring 131. In contrast to the detonator 90 which is uniquely responsive to exterior temperatures, the detonator 120 is cooperatively arranged to uniquely respond to exterior pressure changes. Accordingly, the upper portion of the outer shell 125 is enlarged as illustrated and the displacement member 130 is cooperatively arranged with an enlarged-diameter head 132 on its upper end that is fitted in the enlarged-diameter upper portion of the outer shell 125. Sealing means such as O-rings 133 and 134 are respectively mounted on the enlarged head 132 and the internal wall of the outer shell 125 in the lower reduced-diameter portion of the outer chamber 128 for defining a pressure chamber 135 between the displacement member 133 and the lower face of its enlarged head. A lateral port 136 in the side wall of the outer shell 125 provides fluid communication into the pressure chamber 135. It will be appreciated, therefore, that by increasing the pressure in the pressure chamber, the displacement member 133 will be moved upwardly to an elevated position in the outer chamber 128 once the biasing force of the spring 131 has been overcome. Conversely, when the displacement member 130 is to be returned to its depicted position, the fluid pressure in the chamber 135 is relieved and the biasing spring 131 will then function for returning the displacement member downwardly to its illustrated lower position.

An elongated barrier member 137 formed of a selected fusible alloy is disposed in the inner chamber 124. In keeping with the principles of the invention, the fusible metal alloy is chosen so that the barrier member 135 will remain in its normal solid state until the detonator 120 is subjected to the elevated temperatures of well bore fluids. Hereagain, the predictability as well as the reliability provided by the known melting points or range of melting points of the above-discussed fusible metal alloys will allow the detonator 120 to safely operated under a predetermined range of operating conditions. It should also be noted that by virtue of the pressure control provided by the piston actuator 132, there is an extra dimension of selective control that has not been possible with prior-art detonators.

It will, of course, be recognized that the biasing force provided by the spring 131 must be coordinated with respect to the well bore temperatures and pressures as well as the melting point of the barrier 135 so that the piston actuator 132 will reliably function for elevating the displacement member 130 for uncovering the ports 129 to release the liquified fusible alloy into the lower portion of the outer member 125 when the detonator 120 is to be enabled. In the same fashion, the spring 131 must be capable of returning the displacement member 130 to its lower position for returning the liquified fusible metal to its initial detonation-blocking position in the inner chamber 124 as the well tool carrying the detonator 120 is being returned to the surface and there is a reduction in the pressure in the piston chamber 135. Those skilled in the art will readily appreciate that the hydrostatic pressure in the well bore around the new and improved detonator 120 may be supplemented as needed by pressuring up the annulus in the well bore if it is desired to be more selective as to when the displacement member 130 is to be moved between its lower and upper operating positions. It should also be noted that the detonator 120 can be installed in an enclosed carrier, as at 19, and the well bore pressure communicated to the piston chamber 135 by way of a suitable pressure conduit (not depicted in the drawings) connected to the port 136. Alternatively, if the detonator 120 itself is to be positioned in a well bore, the pressure of the well bore fluids will be directly communicated to the piston chamber 135 by way of the port 136. In either case, the detonator 120 will be appropriately designed to accommodate the expected well bore pressure conditions.

Accordingly, it will be seen that the present invention has new and improved methods and apparatus for selectively initiating various well tools from the surface including those carrying one or more explosive devices.

In particular, the present invention provides a plurality of new and improved explosive detonators which cooperate to prevent the explosive devices coupled thereto from being set off either by extraneous electromagnetic signals or by spurious electrical energy while the tools carrying those devices are at the surface. Moreover, the present invention provides new and improved methods for safeguarding tools with explosive devices from inadvertent detonation and for selectively initiating these tools only after the tools have reached a safe position by rendering the explosive inoperable until those tools have been exposed to elevated well bore temperatures for a finite time period. Other methods and apparatus of the invention render these tools inoperable should they be returned thereafter to the surface without having been operated properly.

While only particular embodiments of the present invention and modes of practicing the invention have been described above and illustrated in the drawings, it is apparent that changes and modifications may be made without departing from the invention in its broader aspects; and, therefore, the aim in the claims which are appended hereto is to cover those changes and modifications which fall within the true spirit and scope of the invention.

What is claimed is:

1. A well tool to be suspended in a well bore containing, well bore fluids at elevated temperatures and comprising:

a tool body;

an explosive device on said tool body;

first means on said tool body including a detonator having a hollow shell and spatially-disposed donor and receptor explosives arranged in said hollow detonator shell for setting off said explosive device upon the detonation of said receptor explosive in response to the passage of the detonation forces produced by said donor explosive through said hollow detonator shell;

barrier means including a normally-solid fusible metal alloy barrier member disposed in said hollow detonator shell between said receptor explosive and said donor explosive blocking the passage of said detonation forces through said hollow detonator shell until said barrier member is melted in response to the suspension of said well tool in well bore fluids having an elevated temperature more than the melting point of said fusible metal alloy; and second means operable for setting off said donor explosive to set off said explosive device after said barrier has been melted.

2. The well tool of claim 1 wherein said fusible metal alloy is selected from the group consisting of binary, ternary, quaternary and quinary eutectic and non-eutectic mixtures of bismuth, lead, tin, cadmium and indium having a melting point lower than at least one of the well bore temperatures that said well tool is expected to encounter.

3. The well tool of claim 1 wherein said first means include a first explosive detonating cord operatively arranged between said explosive device and said receptor explosive; and said second means include a second explosive detonating cord operatively arranged within detonating proximity of said donor explosive.

4. A well tool to be suspended in a well bore containing fluids at an elevated temperature and comprising:

a body;

an explosive device on said body;

means for setting off said explosive device including an explosive detonator mounted on said body and having a hollow detonator shell and donor and receptor explosives arranged in opposite end portions of said hollow detonator shell;

at least one barrier member comprised of a normally-solid fusible metal alloy arranged in the intermediate portion of said detonator shell for obstructing the detonation path of said donor explosive through said detonator shell to prevent detonation of said receptor explosive by said donor explosive so long as said fusible metal alloy has not been transformed to its liquified state by the heating from well bore fluids exterior of said detonator shell having elevated temperatures greater than the melting point of said fusible metal alloy;

passage means in said detonator shell operable only upon the transformation of said fusible metal alloy to its said liquified state for removing the liquified fusible metal alloy from said intermediate portion of said detonator shell and thereby opening said detonation path through said detonator shell so that the detonation of said donor explosive will detonate said receptor explosive for setting off said explosive device; and means for detonating said explosive detonator to set off said explosive device after said fusible metal alloy in said barrier member has been transformed to its said liquified state and removed from said intermediate portion of said detonator shell.

5. The well tool of claim 4 wherein said fusible metal alloy is selected from the group consisting of binary, ternary, quaternary and quinary eutectic mixtures of bismuth, lead, tin, cadmium and indium having melting points greater than the ambient temperature at the surface and less than the predicted temperatures in the well bore interval in which said well tool is to be operated.

6. The well tool of claim 4 wherein said fusible metal alloy is selected from the group consisting of binary, ternary, quaternary and quinary non-eutectic mixtures of bismuth, lead, tin, cadmium and indium having a range of melting points which are greater than the ambient temperature at the surface and less than the predicted temperatures in the well bore interval in which said well tool is to be operated.

7. The well tool of claim 4 further including means on said body operable in response to a selected well bore condition for moving said liquified fusible metal alloy back into said intermediate portion of said detonator shell to obstruct said detonation path and disable said detonator before said well tool is returned to the surface with said detonator still unfired.

8. The well tool of claim 4 further including:

a reservoir for receiving said liquified fusible metal alloy removed from said intermediate portion of said detonator shell; and means operable only if said well tool is being returned to the surface with said detonator still unfired to return said liquified fusible metal alloy in said reservoir back into said intermediate portion of said detonator shell for obstructing said detonation path of said donor explosive through said detonator shell before said well tool has reached the surface.

9. The well tool of claim 4 further including:

means including a reservoir arranged on said body and coupled to said passage means for receiving said liquified fusible metal alloy removed from said intermediate portion of said detonator shell; and displacement means on said body operable in response to an increase in a selected well bore condition for admitting said liquified fusible metal alloy into said reservoir and operable in response to a subsequent decrease in said selected well bore condition for displacing said liquified fusible metal alloy from said reservoir and back through said passage means into said intermediate portion of said detonator shell for safeguarding said explosive device when said well tool is returned to the surface without said detonator having been fired.

10. The well tool of claim 4 wherein said body has a fluid-tight chamber and said explosive device and said detonator are disposed in said fluid-tight chamber.

11. The well tool of claim 10 including means for introducing well bore liquids in said intermediate portion of said detonator shell between said explosives for attenuating the detonation forces of said donor explosive to prevent the detonation of said donor explosive from detonating said receptor explosive should well bore liquids exteriors of said body leak into said fluid-tight chamber.

12. The well tool of claim 4 further including:

means including a reservoir on said body for receiving said liquified fusible metal alloy removed from said intermediate portion of said detonator shell; and temperature-actuated displacement means in said reservoir operable in response to lower well bore temperatures around said well tool as it is being returned to the surface for displacing said liquified fusible metal alloy out of said reservoir and back through said passage means into said intermediate portion of said detonator shell to again obstruct said detonation path to disarm said explosive device when said well tool is being returned to the surface without said detonator having been fired.

13. The well tool of claim 12 wherein said fusible metal alloy is selected from the group consisting of binary, ternary, quaternary and quinary eutectic mixtures of bismuth, lead, tin, cadmium and indium having melting points between the lowest and highest well bore temperatures said well tool is expected to encounter.

14. The well tool of claim 12 wherein said fusible metal alloy is selected from the group consisting of binary, ternary, quaternary and quinary non-eutectic mixtures of bismuth, lead, tin, cadmium and indium having a range of melting points between the lowest and highest well bore temperatures said well tool is expected to encounter.

15. The well tool of claim 4 further including:

means including a reservoir arranged on said body and coupled to said passage means for receiving said liquified fusible metal alloy removed from said intermediate portion of said detonator shell; and temperature-actuated displacement means on said body operable in response to increasing well bore temperatures around said well tool as it is being lowered from the surface for admitting said liquified fusible metal alloy removed from said intermediate portion of said detonator shell into said reservoir and operable in response to decreasing well bore temperatures around said well tool as it is being returned to the surface for displacing said liquified fusible metal alloy out of said reservoir and back into said intermediate portion of said detonator shell for disarming said explosive device when said well tool is being returned to the surface without said detonator having been fired.

16. The well tool of claim 15 wherein said fusible metal alloy is selected from the group consisting of binary, ternary, quaternary and quinary eutectic mixtures of bismuth, lead, tin, cadmium and indium having melting points between the warmest and coolest well bore temperatures said well tool is expected to encounter.

17. The well tool of claim 15 wherein said fusible metal alloy is selected from the group consisting of binary, ternary, quaternary and quinary non-eutectic mixtures of bismuth, lead, tin, cadmium and indium having a range of melting points between the warmest and coolest well bore temperatures said well tool is expected to encounter.

18. An explosive detonator comprising:

encapsulated donor and receptor explosives spatially disposed within detonating proximity of one another; and detonation barrier means comprised of a normally-solid fusible metal alloy arranged between said spatially-disposed explosives for preventing the detonation forces produced by said donor explosive from setting off said receptor explosive until elevated temperatures exterior of said encapsulated explosives which are greater than the melting point of said fusible metal alloy have melted said fusible metal alloy.

19. The detonator of claim 18 wherein said fusible metal alloy is selected from the group consisting of binary, ternary, quaternary and quinary eutectic and non-eutectic mixtures of bismuth, lead, tin, cadmium and indium having melting points which fall between the maximum and minimum exterior temperatures that said detonator is expected to encounter.

20. The detonator of claim 18 further including first means cooperatively arranged for positioning an explosive detonating cord within detonating proximity of said donor explosive and second means cooperatively arranged for positioning an explosive detonating cord within detonating proximity of said receptor explosive.

21. An explosive detonator comprising:

a hollow shell;

a donor explosive in said hollow shell; and detonation barrier means in said hollow shell and including at least one barrier member comprised of a normally-solid fusible metal alloy and operative for attenuating the detonation forces produced by said donor explosive until said barrier member has been melted by an elevated temperature outside of said hollow shell greater than the predetermined melting point of said fusible metal alloy to allow the liquified fusible metal alloy to move away from the detonation path of said donor explosive.

22. The detonator of claim 21 wherein said detonation barrier means include two or more barrier members cooperatively arranged to be alternatively positioned within said hollow body with said fusible metal alloy for each of said barrier members selected from the group consisting of eutectic mixtures of bismuth, lead, tin, cadmium and indium having melting points within a selected overall range of melting points which are lower than the elevated temperatures said detonator is expected to encounter, each of said barrier members being chosen for providing a set of said barrier members to be alternatively utilized for safeguarding said detonator at different operating temperatures which said detonator is expected to encounter.

23. The detonator of claim 21 wherein said detonation barrier means include two or more barrier members cooperatively arranged to be alternatively positioned within said hollow body with said fusible metal alloy for each of said barrier members selected from the group consisting of non-eutectic mixtures of bismuth, lead, tin, cadmium and indium having a range of melting points within a selected overall range of melting points which are lower than the elevated temperatures said detonator is expected to encounter, each of said barrier members being chosen to provide a set of said barrier members to be alternatively utilized for safeguarding said detonator at different operating temperatures which said detonator is expected to encounter.

24. The detonator of claim 21 wherein said fusible metal alloy is selected from the group consisting of binary, ternary, quaternary and quinary eutectic mixtures of bismuth, lead, tin, cadmium and indium having melting points lower than the elevated temperatures which said detonator is expected to encounter.

25. The detonator of claim 21 wherein said fusible metal alloy is selected from the group consisting of binary, ternary, quaternary and quinary non-eutectic mixtures of bismuth, lead, tin, cadmium and indium having melting points lower than the temperatures said detonator is expected to encounter.

26. An explosive detonator comprising:

a hollow shell;

a donor explosive in said hollow shell;

a receptor explosive positioned in the detonation path of said donor explosive through said hollow shell and spatially disposed from said donor explosive for defining an enclosed space in said hollow shell between said donor and receptor explosives;

an opening in said hollow shell communicating the exterior of said hollow shell with said enclosed space;

detonation barrier means in said enclosed space including at least one barrier member comprised of a normally-solid fusible metal alloy and operative for attenuating the detonation forces produced by said donor explosive until said barrier member has been melted by an elevated temperature outside of said hollow shell greater than the melting point of said fusible metal alloy to allow the liquified fusible metal alloy to move out of said enclosed space through said opening;

a reservoir on said hollow shell in communication with said opening for receiving said liquified fusible metal alloy moved out of said enclosed space; and means operatively arranged on said hollow shell for returning said liquified fusible metal alloy in said reservoir back into said enclosed space for disabling said detonator if it is still unfired before being returned to normal ambient temperatures.

27. The detonator of claim 26 wherein said fusible metal alloy is selected from the group consisting of binary, ternary, quaternary and quinary eutectic mixtures of bismuth, lead, tin, cadmium and indium having a melting point that is greater than the coolest temperature that said detonator will encounter.

28. The detonator of claim 26 wherein said fusible metal alloy is selected from the group consisting of binary, ternary, quaternary and quinary non-eutectic mixtures of bismuth, lead, tin, cadmium and indium having a range of melting points that is greater than the coolest temperature that said detonator will encounter.

29. The detonator of claim 26 wherein said means for returning said liquified fusible metal alloy back into said enclosed space includes temperature-actuated displacement means arranged in said reservoir and operable in response to cooler temperatures around said detonator as it is returned to normal ambient temperatures for displacing said liquified fusible metal alloy out of said reservoir and back into said enclosed space.

30. A method for performing a well service operation with a well tool having an explosive device and an explosive detonator for selectively detonating said explosive device and having a donor explosive and a receptor explosive spatially disposed from one another and comprising the steps of:

mounting a barrier comprised of a normally-solid fusible metal alloy between said donor and receptor explosives for deactivating said detonator until said fusible metal alloy is heated to its melting point;

lowering said tool into a well bore containing well fluids at temperatures greater than said melting point for conducting a well service operation at a selected depth interval therein;

postponing the detonation of said detonator for a sufficient length of time for said fusible metal alloy to melt; and selectively detonating said detonator for carrying out said well service operation at said selected depth interval after said barrier has been melted by the well fluids around said well tool.

31. A method for perforating a well bore with a perforating gun having an enclosed fluid-tight carrier carrying an explosive perforating device and a detonator having a donor explosive and a receptor explosive cooperatively arranged in the detonation path of the donor explosive for setting off the explosive perforating device and comprising the steps of:

mounting a barrier formed of a selected fusible metal alloy in the detonation path between said donor and receptor explosives for reliably rendering said detonator temporarily ineffective for setting off said explosive perforating device;

positioning said perforating gun in a well bore containing well fluids at elevated temperatures for heating said barrier to the melting point of said selected fusible metal alloy to liquify said barrier so that the liquified fusible metal alloy will flow out of said detonation path for reliably rendering said detonator effective to set off said explosive perforating device when said perforating gun has been positioned at a selected depth interval in the well bore.

32. The method of claim 31 wherein heating of said barrier is carried out by the elevated temperatures of the well bore fluids exterior of said perforating gun while it is being lowered in the well bore to the selected depth interval and further including the step of selectively initiating said detonator from the surface after said liquified fusible metal alloy has flowed out of said detonation path.

33. A method for perforating a well bore with a perforating gun having an enclosed fluid-tight carrier carrying an explosive perforating device and a detonator having a donor explosive and a receptor explosive cooperatively arranged in the direction path of the donor explosive for setting off the explosive perforating device and comprising the steps of:

measuring the temperature of the well bore fluids in at least one selected interval of said well bore;

arranging a detonation barrier from a selected normally-solid fusible metal alloy having a predetermined melting point less than the temperature of the well bore fluids in said selected well bore interval;

mounting said detonation barrier in said detonator for temporarily obstructing said detonation path between said donor and receptor explosives to reliably render said detonator ineffective for setting off said explosive perforating device so long as said selected fusible metal alloy remains in its normal solid state; and positioning said perforating gun in said selected well bore interval for heating said barrier to the predetermined melting point of said selected fusible metal alloy and liquefying said detonation barrier so that the liquified fusible metal alloy will be removed from said detonation path to prepare said detonator for setting off said explosive perforating device.

34. The method of claim 33 including the step of selectively initiating said detonator from the surface after said liquified fusible metal alloy has been removed from said detonation path.

35. The method of claim 34 wherein said perforating gun is moved to another well bore interval before said detonator is initiated.

* * * * *